US006531831B2

(12) United States Patent
Chou et al.

(10) Patent No.: US 6,531,831 B2
(45) Date of Patent: Mar. 11, 2003

(54) INTEGRATED CIRCUIT FOR LAMP HEATING AND DIMMING CONTROL

(75) Inventors: John Chou, Monterey Park, CA (US); Yung-Lin Lin, Palo Alto, CA (US)

(73) Assignee: O2Micro International Limited, Grand Caymen (KN)

( * ) Notice: Subject to any disclaimer, the term of this patent is extended or adjusted under 35 U.S.C. 154(b) by 0 days.

(21) Appl. No.: 09/825,034

(22) Filed: Apr. 3, 2001

(65) Prior Publication Data

US 2002/0140371 A1 Oct. 3, 2002

Related U.S. Application Data

(60) Provisional application No. 60/203,621, filed on May 12, 2000.

(51) Int. Cl.[7] ..... H05B 41/14

(52) U.S. Cl. ..... 315/225; 315/DIG. 4

(58) Field of Search ..... 315/224, 244, 315/243, DIG. 4, 307, 209 R, 291, DIG. 2, DIG. 5, 225, 277, 119

(56) References Cited

U.S. PATENT DOCUMENTS

| | | | | |
|---|---|---|---|---|
| 4,464,606 | A | 8/1984 | Kane | 315/158 |
| 4,535,399 | A | 8/1985 | Szepesi | 363/41 |
| 4,541,041 | A | 9/1985 | Park et al. | 363/41 |
| 4,672,528 | A | 6/1987 | Park et al. | 363/98 |
| 4,727,469 | A | 2/1988 | Kammiller | 363/56 |
| 4,794,506 | A | 12/1988 | Hino et al. | 363/25 |

(List continued on next page.)

OTHER PUBLICATIONS

Phase Shifted, Zero Voltage Transition Design Considerations and the UC3875 PWM Controller, by Bill Andreycak, Unitrode, Application Note, May 1997, pp. 1–14.

"Fixed–Frequency, Resonant–Switched Pulse Width Modulation with Phase–Shifted Control", Bob Mammano and Jeff Putsch, from *Power Supply Design Seminar*, Unitrode, 1991, pp. 5–1 to 5–7.

(List continued on next page.)

*Primary Examiner*—Don Wong
*Assistant Examiner*—Chuc D Tran
(74) *Attorney, Agent, or Firm*—Grossman Tucker Perreault & Pfleger, PLLC

(57) ABSTRACT

An electronic ballast for lamps or tubes is provided. In one embodiment the present invention includes a ballast controller that includes filament heating circuitry and dimming circuitry. The filament heating circuitry may include preheat dimming circuits which preheat the filaments for a predetermined time period prior to striking the lamp, and steady-state heating circuitry that continually heats the filaments during steady state operation of the lamp. The steady state heating circuitry may be adapted to heat the filaments inversely proportional to the dim desired value of the lamp. The dimming circuitry may include conventional analog dimming and/or burst mode dimming to define a wide range of dimming characteristics for the lamp.

11 Claims, 3 Drawing Sheets

U.S. PATENT DOCUMENTS

| | | | | | |
|---|---|---|---|---|---|
| 4,814,962 | A | | 3/1989 | Magalhaes et al. | 363/16 |
| 4,833,584 | A | | 5/1989 | Divan | 363/37 |
| 4,855,888 | A | | 8/1989 | Henze et al. | 363/17 |
| 4,860,189 | A | | 8/1989 | Hitchcock | 363/132 |
| 4,864,483 | A | | 9/1989 | Divan | 363/37 |
| 4,912,622 | A | | 3/1990 | Steigerwald et al. | 363/98 |
| 4,933,605 | A | * | 6/1990 | Quazi et al. | 315/224 |
| 4,935,857 | A | | 6/1990 | Nguyen et al. | 363/17 |
| 4,952,849 | A | | 8/1990 | Fellows et al. | 315/307 |
| 4,953,068 | A | | 8/1990 | Henze | 363/17 |
| 4,992,919 | A | | 2/1991 | Lee et al. | 363/17 |
| 5,017,800 | A | | 5/1991 | Divan | 307/66 |
| 5,027,263 | A | | 6/1991 | Harada et al. | 363/16 |
| 5,027,264 | A | | 6/1991 | Dedoncker et al. | 363/16 |
| 5,105,127 | A | | 4/1992 | Lavaud et al. | 315/291 |
| 5,113,334 | A | | 5/1992 | Tuson et al. | 363/25 |
| 5,132,888 | A | | 7/1992 | Lo et al. | 363/17 |
| 5,132,889 | A | | 7/1992 | Hitchcock et al. | 363/17 |
| 5,157,592 | A | | 10/1992 | Walters | 363/17 |
| 5,198,969 | A | | 3/1993 | Redl et al. | 363/17 |
| 5,208,740 | A | | 5/1993 | Ehsani | 363/124 |
| 5,231,563 | A | | 7/1993 | Jitaru | 363/98 |
| 5,235,501 | A | | 8/1993 | Stuart et al. | 363/17 |
| 5,268,830 | A | | 12/1993 | Loftus, Jr. | 363/17 |
| 5,285,372 | A | | 2/1994 | Hyunh et al. | 363/132 |
| 5,291,382 | A | | 3/1994 | Cohen | 363/16 |
| 5,305,191 | A | | 4/1994 | Loftus, Jr. | 363/17 |
| 5,363,020 | A | | 11/1994 | Chen et al. | 315/209 R |
| 5,384,516 | A | | 1/1995 | Kawabata et al. | 315/160 |
| 5,394,064 | A | | 2/1995 | Ranganath et al. | 315/209 |
| 5,402,329 | A | | 3/1995 | Wittenbreder, Jr. | 363/16 |
| 5,412,557 | A | | 5/1995 | Lauw | 363/37 |
| 5,418,703 | A | | 5/1995 | Hitchcock et al. | 363/17 |
| 5,420,779 | A | | 5/1995 | Payne | 363/56 |
| 5,422,546 | A | | 6/1995 | Nilssen | 315/219 |
| 5,426,350 | A | * | 6/1995 | Lai | 315/209 R |
| 5,430,632 | A | | 7/1995 | Meszlenyi | 363/17 |
| 5,430,641 | A | | 7/1995 | Kates | 363/133 |
| 5,448,155 | A | | 9/1995 | Jutras | 323/285 |
| 5,448,467 | A | | 9/1995 | Ferreira | 363/17 |
| 5,481,160 | A | | 1/1996 | Nilssen | 315/209 R |
| 5,510,974 | A | | 4/1996 | Gu et al. | 363/134 |
| 5,514,921 | A | | 5/1996 | Steigerwald | 307/125 |
| 5,546,300 | A | | 8/1996 | Lee et al. | 363/132 |
| 5,559,395 | A | | 9/1996 | Venkitasubrahmanian | 315/247 |
| 5,559,688 | A | | 9/1996 | Pringle | 363/89 |
| 5,583,402 | A | | 12/1996 | Moisin et al. | 315/307 |
| 5,615,093 | A | | 3/1997 | Nalbant | 363/25 |
| 5,619,402 | A | | 4/1997 | Liu | 363/20 |
| 5,638,260 | A | | 6/1997 | Bees | 363/17 |
| 5,646,836 | A | | 7/1997 | Sadarnac et al. | 363/98 |
| 5,669,238 | A | | 9/1997 | Devers | 62/657 |
| 5,684,683 | A | | 11/1997 | Divan et al. | 33/65 |
| 5,694,007 | A | | 12/1997 | Chen | 315/247 |
| 5,712,533 | A | | 1/1998 | Corti | 315/169.3 |
| 5,715,155 | A | | 2/1998 | Shahani et al. | 363/132 |
| 5,719,474 | A | | 2/1998 | Vitello | 315/307 |
| 5,731,652 | A | | 3/1998 | Shimada | 310/316 |
| 5,736,842 | A | | 4/1998 | Jovanovic | 323/222 |
| 5,742,495 | A | | 4/1998 | Barone | 363/65 |
| 5,742,496 | A | | 4/1998 | Tsutsumi | 363/95 |
| 5,744,915 | A | | 4/1998 | Nilssen | 315/209 R |
| 5,747,942 | A | | 5/1998 | Ranganath | 315/224 |
| 5,748,457 | A | | 5/1998 | Poon et al. | 363/16 |
| 5,751,115 | A | * | 5/1998 | Jayaraman et al. | 315/225 |
| 5,764,494 | A | | 6/1998 | Schutten et al. | 363/17 |
| 5,774,346 | A | | 6/1998 | Poon et al. | 363/17 |
| 5,781,418 | A | | 7/1998 | Chang et al. | 363/16 |
| 5,781,419 | A | | 7/1998 | Kutkut et al. | 363/17 |
| 5,784,266 | A | | 7/1998 | Chen | 363/16 |
| 5,796,598 | A | | 8/1998 | Nowak et al. | 363/37 |
| 5,818,172 | A | | 10/1998 | Lee | 315/86 |
| 5,834,889 | A | | 11/1998 | Ge | 313/493 |
| 5,844,378 | A | | 12/1998 | Locascio et al. | 315/307 |
| 5,844,540 | A | | 12/1998 | Terasaki | 345/102 |
| 5,854,617 | A | | 12/1998 | Lee et al. | 345/102 |
| 5,856,916 | A | | 1/1999 | Bonnet | 363/20 |
| 5,875,103 | A | | 2/1999 | Bhagwat et al. | 363/17 |
| 5,880,940 | A | | 3/1999 | Poon | 363/20 |
| 5,886,477 | A | | 3/1999 | Honbo et al. | 315/209 PZ |
| 5,886,884 | A | | 3/1999 | Baek et al. | 363/48 |
| 5,894,412 | A | | 4/1999 | Faulk | 363/56 |
| 5,900,700 | A | | 5/1999 | Arndt et al. | 315/291 |
| 5,910,709 | A | | 6/1999 | Stevanovic et al. | 315/225 |
| 5,917,722 | A | | 6/1999 | Singh | 363/132 |
| 5,920,155 | A | * | 7/1999 | Kanda et al. | 315/209 R |
| 5,923,129 | A | | 7/1999 | Henry | 315/307 |
| 5,930,121 | A | | 7/1999 | Henry | 363/16 |
| 5,932,976 | A | | 8/1999 | Maheshwari et al. | 315/291 |
| 5,939,830 | A | | 8/1999 | Praiswater | 315/DIG. 4 |
| 5,946,200 | A | | 8/1999 | Kim et al. | 363/17 |
| 6,011,360 | A | | 1/2000 | Gradzki et al. | 315/244 |
| 6,020,689 | A | * | 2/2000 | Gradzki et al. | 315/224 |
| 6,114,814 | A | | 9/2000 | Shannon et al. | 315/219 |
| 6,211,623 | B1 | * | 4/2001 | Wilhelm et al. | 315/224 |
| 6,326,740 | B1 | * | 12/2001 | Chang et al. | 315/194 |

OTHER PUBLICATIONS

"Zero Voltage Switching Resonant Power Conversion", by Bill Andreycak, from *Power Supply Design Seminar*, Unitrode, 1991, pp. A2–1 to A2–24; and A2–1A to A2–3A.

"Resonant Mode Converter Topologies", by Bob Mammano, from *Power Supply Design Seminar*, Unitrode, 1991, pp. P3–1 to P3–12.

"The New UC3879 Phase–Shifted PWM Controller Simplifies the Design of Zero Voltage Transition Full–Bridge Converters", by Laszlo Balogh, Unitrode, Application Note, 1995, pp. 1–8.

"A Comparative Study of a Class of Full Bridge Zero–Voltage–Switched PWM Converters", by W. Chen et al., 1995 IEEE, pp. 893–899.

"Optimum ZVS Full–Bridge DC/DC Converter with PWM Phase–Shift Control; Analysis, Design Considerations, and Experimental Results", by Richard Red I et al., 1994 IEEE, pp. 159–165.

"A Frequency/PWM Controlled Converter with Two Independently Regulated Outputs", by R.A. Fisher et al., HFPC, May 1989, pp. 459–471.

"High Density Power–Hybrid Design of a Half–Bridge Multi–Resonant Converter", by Richard Farrington, et al., HFPC–Virginia Polytechnic Institute, May 1990, pp. 26–33.

"Small–Signal Analysis of the Zero–Voltage Switched Full–Bridge PWM Converter", V. Vlatkovic et al., HFPC–Virginia Polytechnic Institute, May 1990, pp.262–272.

"Feasible Characteristic Evaluations of Resonant Tank PWM Inverter–Linked DC–DC HIgh–Power Converters for Medical–Use High–Voltage Application", by H. Takano et al., 1995 IEEE, pp. 913–919.

* cited by examiner $V_{DIM}$ Low --> Duty Cycle High

Burst PWM $V_{DIM}$ High --> Duty Cycle Low

INTEGRATED CIRCUIT FOR LAMP HEATING AND DIMMING CONTROL

This application claims the benefit of Provisional application Ser. No. 60/203,621, filed May 12, 2000.

BACKGROUND OF THE INVENTION

Electronic ballast is needed to drive a hot cathode fluorescent lamp (HCFL). The electronic ballast needs to provide both preheating power for the filaments and striking voltage to ignite the lamp. After the lamp is ignited, the electronic ballast should regulate the lamp current and continue to provide heating power, though at less level, for the filaments. For the conservation of energy, it is preferred an electronic ballast is capable of dimming control. When HCFL is operated at various dimming conditions, the heating power to the filaments should be adjusted accordingly to ensure a normal life of filaments. Accordingly, the present invention provides a control circuit that provides both preheating power to the filaments, and variable dimming control of the lamp.

SUMMARY OF THE INVENTION

Accordingly, the present invention provides an electronic ballast system comprising a variable voltage source generating a first signal indicative of a desired dim value for a hot cathode fluorescent lamp, and a second signal indicative of the average power of said variable voltage source. A ballast controller is provided that includes lamp filament current control circuitry comprising preheat filament current control circuitry generating a preheat filament current to the filaments of the lamp for a predetermined time period, and steady state filament current control circuitry generating a steady state filament heating current in reverse proportion to the desired dim value during times after said predetermined period of time. The controller also includes dimming circuitry comprising a burst PWM (pulse width modulated) signal generator receiving said first signal and generating a PWM dimming signal proportional to a desired dim value, current feedback circuitry receiving a signal indicative of the current supplied to said lamp and comparing said signal indicative of the current supplied to said lamp and said PWM dimming signal to generate a variable power control signal; and inverter circuitry receiving said variable power control signal and generating an AC signal proportional to said power control signal by inverting said second signal. The ballast system further includes output circuitry coupled to said inverter circuitry comprising a resonant tank circuit receiving said AC signal to deliver striking and steady state sinusoidal power to said lamp.

In another embodiment, the present invention provides an electronic ballast system comprising a variable voltage source generating a first signal indicative of a desired dim value for a hot cathode fluorescent lamp, and a second signal indicative of the average power of said variable voltage source. A ballast controller is provided that includes lamp filament current control circuitry comprising preheat filament current control circuitry generating a preheat filament current to the filaments of said lamp for a predetermined time period and a steady state filament current control circuit generating a steady state filament heating current during times after said predetermined period of time; dimming circuitry to vary the power delivered to said lamp as a function of the value of said first signal; and a full bridge inverter circuit generating an AC signal from said second signal based on said dimming circuitry. The ballast also includes output circuitry coupled to the output of said full bridge inverter comprising a resonant tank circuit receiving said AC signal and generating a sinusoidal signal to deliver striking and steady state power to said lamp.

It will be appreciated by those skilled in the art that although the following detailed description will proceed with reference being made to exemplary embodiments and methods of use, the present invention is not intended to be limited to these exemplary embodiments and methods of use. Rather, the present invention is of broad scope and is intended to be limited only as set forth in the accompanying claims.

Other features of the present invention will become apparent to those skilled in the art as the following detailed description proceeds, and upon reference to the drawings, wherein like numerals depict like parts, and wherein:

DETAILED DESCRIPTION OF THE INVENTION

Figure 1:
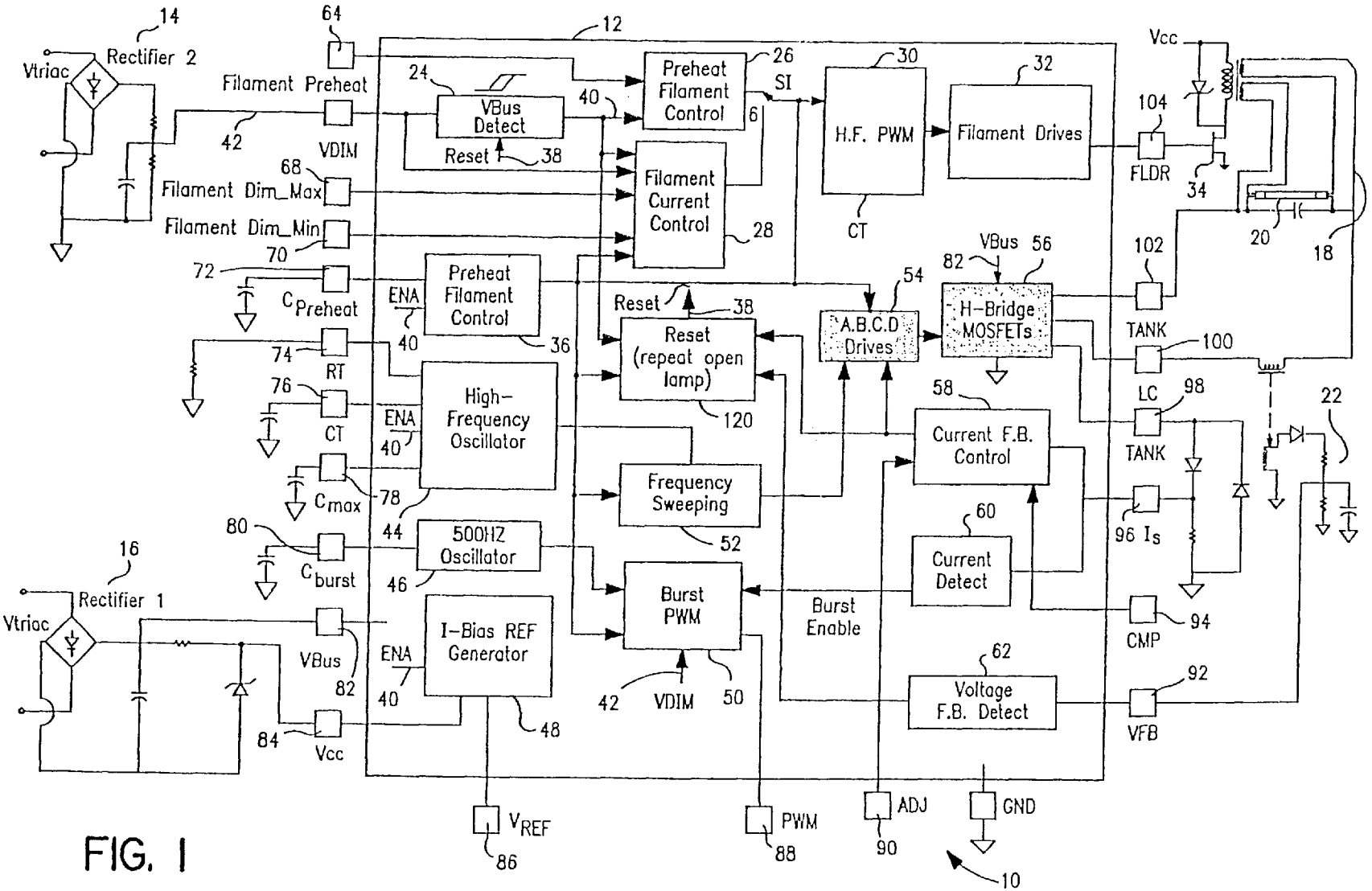
FIG. 1 is a block diagram of an exemplary lamp dimming and heating control circuit of the present invention.

Referring to FIG. 1, an exemplary ballast control system 10 for a hot cathode fluorescent lamp (HCFL) is provided. The control system 10 includes conventional rectifiers 14 and 16 which generate a dim level voltage signal (Rectifier 2) and a line-level voltage signal (Rectifier 1), a controller 12 that includes filament preheating circuitry, steady state filament heating circuitry, dimming circuitry, and inverter circuitry for generating a high voltage AC signal for driving a hot cathode fluorescent lamp (HCFL). The system further includes drive circuitry 18 supplying preheat and steady-state filament heat current to a lamp 20, and controlled voltage for operation of the lamp 20. Feedback circuitry 22 is provided to generate feedback signals indicative of conditions at the lamp. Each of these functional components are described in greater detail below.

It must be understood at the outset that the block diagram IC implementation of FIG. 1 is an exemplary single-IC embodiment for controlling one or more HCFL(s) that includes filament preheat circuitry and dimming circuitry. Those skilled in the art will recognize that IC depicted in FIG. 1 is only one example of many implementations of the present invention, and the present invention is not limited to the exemplary configuration of FIG. 1. Moreover, the following detailed description will proceed with reference to specific pinouts of the IC of FIG. 1 however, these specific pinouts are only exemplary and are likewise not intended to limit the invention.

Filament Heating Control

The controller 12 of the present invention includes both preheat filament heating control circuitry 26 to control and deliver a predetermined current to the filaments of a lamp for a predetermined period of time, and steady state filament current control circuitry 28 to control the supply of current to the filaments during steady state operation of the lamp. As is understood in the art, before striking lamps of the hot cathode variety, the filaments must be heated before applying the necessary strike voltage. The following description is directed to the circuitry and methodology of blocks 24, 26, 28, 30 and 32 of the controller 12 of the exemplary embodiment.

A more detailed description of the dimming circuitry is provided below. However, for purposes of understanding filament heating control, rectifier 2 (14) generates a DC voltage that is determined by the rectifier's position angle, for example, as set by the combination of the position of the Triac in relation to the voltage divider of Rectifier 2. This process is well understood in the art. This generates a voltage signal proportional to desired dim value, Vdim 42. The dim level signal 42 is input into controller and into the VBus detect block 24. In the exemplary embodiment VBus detect 24 comprises a generic hysteresis comparator that detects the presence of voltage at the Triac and is used to generate an enable signal 40 which turns on the preheat filament control circuitry 26 and filament control circuitry 28 (and other components of the controller 12 described below). In other words, controller 12 does not generate either preheat or steady state filament current in the absence of a viable voltage generated by the Triac.

As is understood in the ballast arts, and in particular ballasts for driving HCFLs, different lamps 20 may require different filament preheat current and/or time in which filaments are preheated. Accordingly, the present invention includes pinout 64 which is a user-definable pin for supplying a signal proportional to the amount of desired preheat current to be delivered to the filaments of the lamp. Likewise, pinout 72 permits ballast designers to set a time period defining a preheat time as may be set, for example, by the external capacitor attached to $C_{preheat}$ pin 72. To establish a minimum and maximum filament current used by the lamp during steady state operation, pins 68 and 72 are used to establish the minimum and maximum amount of filament current to be delivered to the filaments of the lamp 20.

Figure 2:
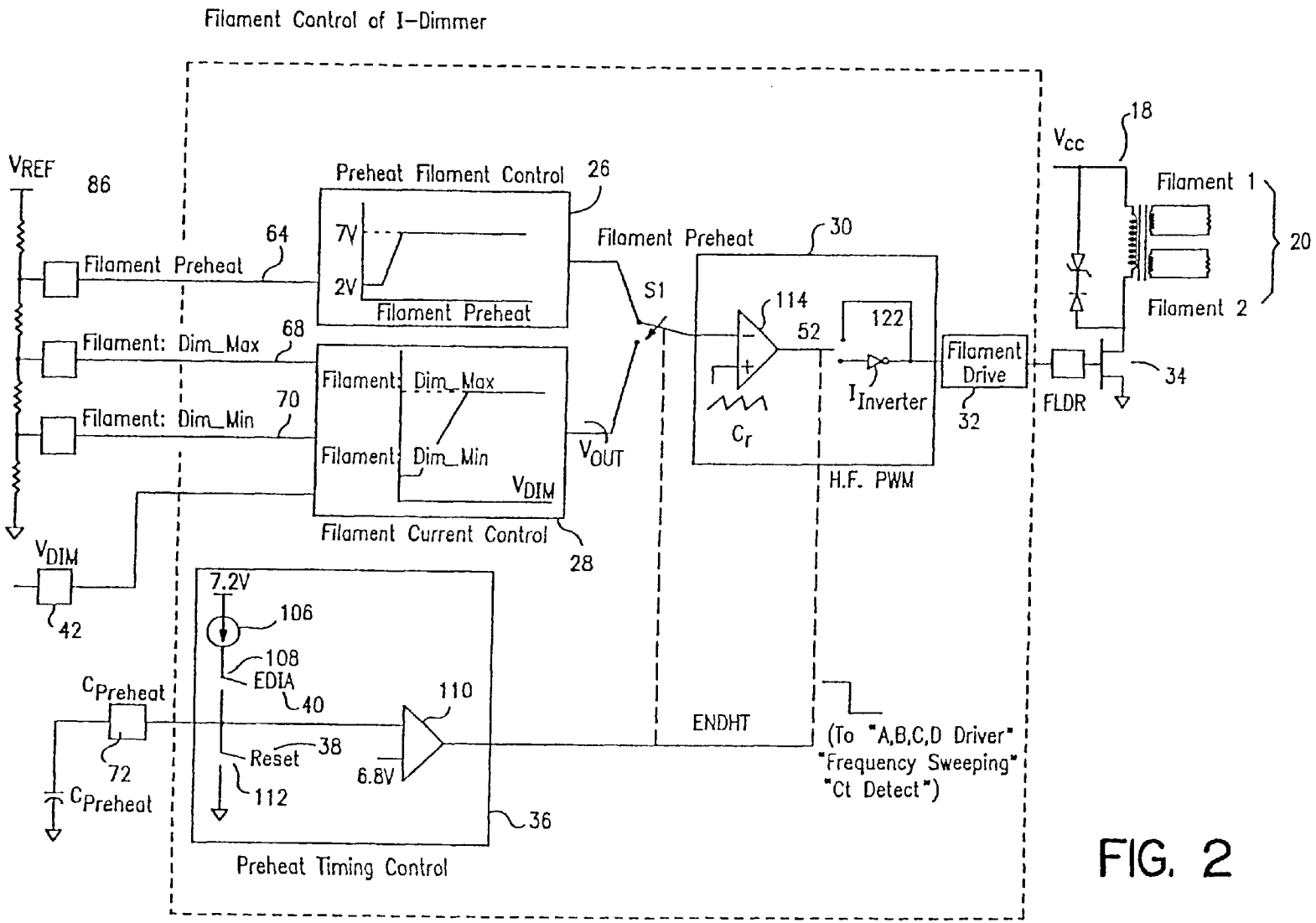
FIG. 2 is an exemplary circuit for lamp filament current control according to the present invention.

Turning to the detailed exemplary block diagram of FIG. 2, exemplary circuitry is shown for the preheat filament control box 26, the steady state filament current control box 28, the high frequency pulse width modulator box 30 and the preheat timing control box 36 of FIG. 1. The filament preheat signal 64, the maximum steady state filament heat current control signal 68 and the minimum steady state filament heat current control signal 70 (titled filament DIM_MAX and filament DIM_MIN respectively) can be generated, for example, using the voltage divider and a voltage reference signal Vref 86, as shown. Those skilled in the art will recognize that the depicted generation of the signal is only exemplary and may be generated in numerous ways to achieve the functionality described herein below, and all such alternatives are deemed within the scope of the present invention. The filament preheat pin 64 sets the preheat level for a particular lamp. The filament preheat process is described below.

Once enabled by the VBus detection circuitry 24 (described above), the preheat filament control circuitry 26 receives the filament preheat signal 64 and generates a DC signal indicative of (or proportional to) a desired current setting for filament preheat. Preheat filament control circuitry 26 essentially comprises a selector switch that is controlled by the enable signal that passes through the signal 64 for generating a predetermined filament current for preheating the filaments of the lamp. In the exemplary embodiments shown in FIG. 2, the range typically required by most lamp manufacturers is between about 2 volts to about 7 volts, although this range may be set to any desired level as may be dictated by the operational characteristics of the lamp.

The preheat time is set by the preheat timing control circuitry 36 and is generally defined as follows. External capacitor $C_{preheat}$ at pinout 72 generally defines the time in which preheat current generated by circuitry 26 preheats the lamp. As is readily understood in the art, a current or voltage source 106 is fed through a switch 108 that is controlled by the enable signal 40 to charge the preheat capacitor. A comparator 110 compares the voltage generated by the charging of the preheat capacitor to a reference voltage (in the example of FIG. 2 the reference voltage is depicted as 6.8 volts, but may be chosen as any reference voltage for a desired output). Typically, the current or voltage source 106 is chosen to be greater than the reference voltage that is fed into the comparator 110, although the reverse may equally be true depending on the switching scheme provided. Once the charge on the preheat capacitor exceeds the reference voltage, the comparator 110 generates a control signal to which the conduction states of switches S1 and S2, discussed below. The preheat timing control circuitry 36 further includes a reset switch 112 which is controlled by a reset signal 38 and operates to bleed the energy stored in the preheat capacitor so that false signal into the comparator is avoided after the controller is reset. As will be appreciated, the time constant of the preheat capacitor is proportional to the defined preheat time period of the controller of the present invention, and may be set to any desired time by choosing a desired capacitor. The filament preheat time period may be likewise adjusted by raising or lowering the reference voltage that is supplied to the comparator 110 to shorten or longer the duration which the preheat filament control circuitry 26 delivers preheat current to the filaments of the lamp.

Once the time period defined by the preheat timing control circuit 36 expires switch S1 switches (as controlled by the control signal generated by the comparator 110) to the output of the filament current control circuit 28 which supplies steady state filament current to the lamp. To insure a satisfactory operational range for steady state current to be supplied to the filaments, the filament control circuitry 28 sets a minimum and maximum current to be supplied to the filaments of the lamp, via signal 68 and 70. Operationally, circuitry 28 receives the particular dim voltage as set by rectifier 2 (14) and insures that the value of the dim voltage operates between the minimum and maximum values set by signals 68 and 70.

During both the preheat time and steady state time the output signal of circuits 26 and 28 are supplied to the high frequency pulse width modulation circuit 30 to deliver a proportional amount of filament current to the filaments of the lamp during these two time periods. The high frequency pulse width modulator circuit essentially comprises a comparator 114 that compares the output of circuits 26 or 28 to a high frequency sawtooth signal ($C_t$) as may be provided, for example, by the high frequency oscillator 44 shown in FIG. 1. The output signal of both circuits 26 and 28 is a DC signal switch 34 is provided to set the duty cycle of a PWM signal generated by the exemplary flyback drive circuit 18 to deliver the desired filament heating current. The intersection of the DC signal and the sawtooth signal controls the duty cycle of the PWM signal, as determined by the comparator 114. Filament drive circuitry 32 is provided to buffer the output of comparator 114 and the relative high impedance of the lamp.

In the exemplary embodiment, the dim voltage signal Vdim 42 is proportional to the desired dim value. As is understood in this art, when the lamp is operating under normal operating conditions, the power (delivered by the inverter topology of the A,B,C,D, switch drives 54 and the full bridge switches 56) supplied to the electrodes of lamp also has the effect of heating the filaments of the lamp. Under variable dimming conditions where power is controllably delivered to the lamp, the amount of heating current provided by the power supply 54 and 56 is proportional to the dim value desired. As will be described in detail below, Vdim 42 is the voltage that determines the amount of power delivered by the inverter switch circuit 54 and 56. As the desired brightness increases, the value of Vdim increases, and vice-versa. Accordingly, to conserve power and prevent overheating of the filaments, the circuitry of FIG. 2 ensures that as the desired dim value increases, the output of circuitry 30 decreases as described below. The default states of switch S1 is to couple circuitry 26 to the comparator 114. The default state of switch S2 is to bypass inverter 122, as shown.

Since the output of circuit 28 is in proportion to the desired dim value, the high frequency PWM circuit 30 includes an inverter selected by switch S2 which engages or bypasses inverter 122. When the preheat time is ended, preheat timing control circuit 36 generates a signal, ENDHT, indicative of the end of the preheat period. The ENDHT controls the conduction states of switches S1 and S2. When switch S1 switches to couple circuit 30 with circuit 28, switch S2 engages to couple the inverter 122 to the output of comparator 114. The output of the inverter delivers a PWM driving signal to filament drives 32 in reverse proportion to the desired dim value. As described above the inverted and non-inverted outputs of the PWM circuit 30 generate a control signal for switch 34 to generate a filament current signal via converter 18.

Striking and Steady-State Operation of the Lamp

Referring again to FIG. 1, and assuming that the preheat period has expired, the ENDHT signal is activated which activates the frequency sweeping circuitry 52 and the high frequency oscillator 44 to drive the H-Bridge MOSFETs switches 56 via the A, B, C, D drives 54 to deliver power to the lamp 20. At the output, an LC resonant tank circuit formed the primary side of the transformer and the capacitor in parallel with lamp is provided which provides the necessary striking and steady state voltage for the lamp, as discussed below.

As will be made clear in the discussion below of the dimming functionality of the controller 12 of the present invention, initially, the output of the current comparator in the current detector circuit 60 is high since initially there is no lamp current and thus no detected current at the Is end 96. Also, since the current detector 60 prohibits the low-frequency PWM burst mode into the error amplifier. Similarly, the voltage feedback detector 62 generates a low output since the VFB pin 92 is below a threshold set by circuitry 62 (assuming that there is a viable lamp present). In this case, the frequency sweeper 52 begins generating drive signals to the A, B, C, D drives 54 starting at an upper frequency and sweeping downward to a predetermined lower frequency. At some point during sweeping, the frequency delivered to drives 54 (which, as is fully understood in the art drives the inverter switches 56 to generate an AC signal at the frequency of the drives 54) matches the resonant frequency of the LC tank circuit. At this point, maximum voltage is applied to the lamp 20 and the lamp is struck. Once the current detector 60 observes current in the tank circuit (meaning that the lamp is now conducting and has successfully struck on) the output of the current detect circuit 60, and more specifically the current feedback controller 58 decreases, thereby controlling the phase between the four signals of the drive circuitry 54 which operates to increase or reduce power. This phase shifting technique for full bridge/H-Bridge topologies is well known in the art. Once struck, the frequency sweeping circuitry 52 continues sweeping downward below the resonant frequency of the resonant tank circuit 22 to an operating frequency set by external resistors and capacitors RT (74) and CT (76), respectively. Power is delivered to the lamp 20 in this manner.

Dimming Control

Still referring to FIG. 1, the exemplary controller 12 of the present invention provides two methods of dimming: conventional analogue dimming which operates to directly control the amount of current delivered to the lamp, and a burst mode technique which adjusts the amount of current delivered to the lamp via the duty cycle of a controllable pulse width modulated signal. For conventional analogue dimming, the dim voltage signal 42 is input into the current feedback control circuit 58 (for example, via the adjustment pin ADJ 90) and is compared with the feedback current Is 96 to increase or decrease the phase between the drive signals in the A, B, C, D drive circuitry 54, thereby raising or lowering the amount of current delivered to the lamp 20. Is 96 is derived from pin LC 98 which is coupled to one of the MOSFETs in the bridge 56 (fro example a lower switch in the bridge 56 may be chosen for this purpose). The circuit coupling Is to LC is a rectifier and a sense resistor to generate a DC value for Is.

Alternatively, the controller 12 of the present invention can include burst mode dimming circuitry which permits greater dimming range than conventional analogue dimming. In the exemplary controller of FIG. 1, the burst mode dimming circuitry includes a low frequency oscillator 46 and a PWM signal generator 50. If the controller 12 has burst mode dimming enabled, the ADJ pin 90 is set to a fixed voltage, preferably, a voltage proportional to the maximum allowable lamp current, for reasons that will become apparent below.

Figure 3A:
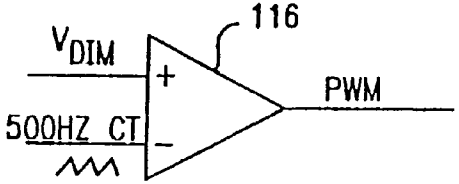
FIGS. 3A, 3B and 3C depict circuit examples and timing diagrams for the exemplary HCFL dimming circuitry of the present invention.

The low frequency oscillator 46 generates a sawtooth signal having a frequency much less than the frequency of operation of the inverter switches 56 set by the high frequency oscillator 44. For example, the low frequency oscillator can be chosen to be operate at 500 Hz, as set by the external capacitor at the CBurst pin 80, while the frequency of operation of the circuit determined by the high frequency oscillator 44 may be on the order of 10 to a 1,000 kHz. Referring now to FIG. 3, the burst mode PWM signal generating circuitry 50 comprises a comparator that compares the dim voltage signal 42 VDim to the sawtooth signal generated by the low frequency oscillator 46. The output is a PWM signal shown at the PWM pin 88 of FIG. 1.

In the exemplary embodiment, when burst mode dimming is enabled by the controller 12, the PWM pin 88 is coupled to the current feedback pin Is 96 which causes the circuit to operate as follows. Note that the intersection of the dim voltage signal VDim with the sawtooth signal via comparator 116 generates a PWM signal having a duty cycle defined by the intersection between these two values. Moreover, as set out above, for burst mode dimming operability the ADJ pin is fixed at a value proportional to the maximum allowable operating current for the lamp. The output PWM signal from the comparator 116 has two states: when off the PWM pin is high impedance which has no effect on the lamp operation, and when on has the value of the PWM signal. When the comparator is off (or low) the lamp operates at the maximum rate of current set by the ADJ pin, since both the PWM signal (and the feedback current signal $I_S$) and the ADJ signal 90 are input into the current feedback control circuit 58. The current feedback control circuitry 58 comprises a summer circuit which sums the value of the PWM signal and $I_S$ and compares this value to the value of ADJ. Typically, the value of ADJ is set lower than the PWM signal. When the PWM signal is high, the summed value of $I_S$ and PWM causes the output of the current feedback control circuit 58 to go low which in turn turns off the drive circuitry 54, thereby turning off the bridge switches 56 and momentarily removing power from the load.

Figure 3C:
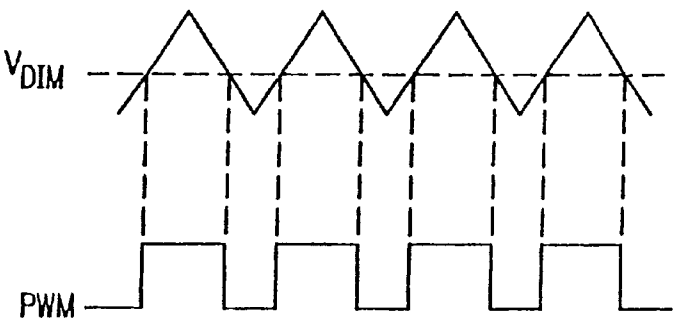
Figure 3B:
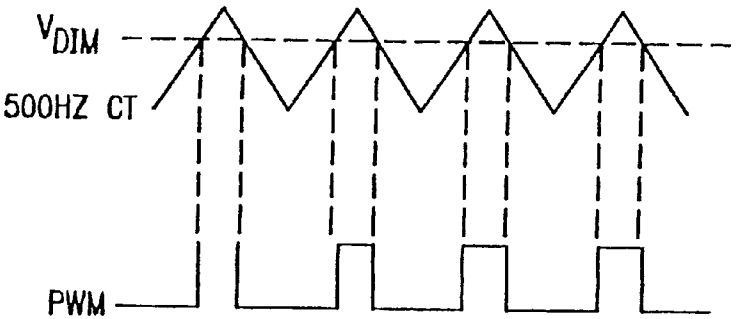

Thus, as can be seen, the greater the duty cycle of the PWM signal generated by comparator 116 the dimmer the lamp since the value of the on times of the PWM is less than the value set by the ADJ pin, i.e., a value proportional to the maximum rated lamp current. Likewise, the lower the duty cycle of the PWM signal 50 means a greater percentage of the ADJ value controlling the lamp current per period of operation, since the ADJ value is controlling when the PWM signal is off. In the exemplary embodiment, the burst PWM circuitry 50 uses the PWM signal generated by the comparator 116 to couple and decouple a voltage source to the PWM pin 88. The voltage source has the PWM value when on, and is high impedance (open circuit) when off. This concept is shown in the timing diagrams of FIGS. 3B and 3C where the intersection between VDim and the low frequency sawtooth signal generates a low duty cycle (FIG. 3B) and a high duty cycle (FIG. 3C). Note that the greater the value of VDim the lower the value of the duty cycle.

Reset and Failed Lamp Circuitry

Further, a voltage feedback circuit 62 receives a voltage feedback signal from pin 92 which is taken across the tank circuit (more specifically, across the voltage divider depicted to generate a signal that is on the order of a few volts as compared with the high voltage supplied to the lamp) to generate a signal indicative of an open or failed lamp condition. Similarly, the current feedback controller and the current detect circuits 58 and 60 respectively, monitor a current across the lamp via pin 96 to determine, in addition to those functions described above, the current condition at the lamp which may be indicative of a short circuit condition on the lamp.

If there is an open lamp or damaged lamp condition at the load, the controller 12 of the exemplary embodiment operates as follows. Since, as described above, once the preheat period expires the frequency sweeper 52 and switches 56 are activated, there is no feedback current (before the lamp is struck). Thus, the output of the current feedback control 58 is High which causes the switches 56 to operate at maximum overlap, but the switches 56 are not (initially) operating near the resonant frequency of the tank circuit and therefore relatively little voltage appears at the transformer. As the frequency sweeps downward and approaches the resonant frequency of the tank circuit 22, the voltage feedback at the VFB pin 92 increases. The voltage feedback detect circuit 62 essentially comprises a comparator that compares the feedback voltage 92 with a predetermined threshold voltage (not shown). When the feedback voltage exceeds the threshold voltage, the resulting output of the comparator is sent to the reset circuit 120 which in turn generates a reset signal 38. In particular the reset signal 38 is supplied to the Vbus Detection circuit 24 which generates a disable signal (e.g., the compliment of the enable signal 40) which disables the oscillator 44 and the frequency sweeper 52, and the drive circuits 54 and switches 56. Also, the reset signal 38 activates the switch 112 (FIG. 2) to bleed energy stored in the preheat capacitor 72. So as not to unintentionally disable the controller, the threshold voltage used by the voltage detection comparator 62 should be set so that an open lamp voltage is higher than a normal striking voltage to ensure sufficient striking. After a reset, the controller 12 of the present invention can be adapted to shut down all the components for a predetermined time period and after the predetermined time period, attempt to restrike the lamp.

Reset circuitry 120 is triggered by the output of the voltage comparator which generates the reset signal 38 which is utilizes by the present invention during a full system reset, and in a condition where the lamp fails to strike (e.g., open or damaged lamp) to reset those functional components which require an initial state to operate correctly. Also, as described above, rectifier 2 generates the dim voltage signal 42 via the voltage divider depicted in FIG. 1. The enable signal 40 generated by the VBus detect circuitry 24 is a trigger signal for those components receiving the enable signal which is based on the conduction angle (i.e., proportional to the DC value of VDim 42) that generally enabled the controller 12 of the present invention. Essentially, VDim is compared to a reference voltage such that if VDim is greater than a preset reference voltage (as may be generated by the reference voltage generator 48) then the IC is enabled via the enable signal 40. Rectifier 1 (16) generates two signals in the exemplary embodiment of the present invention. The first signal, VBus 82 is a DC voltage indicative of the average power at the source of VTriac. VBus 82 is essentially used as a rail voltage used for the inverter switches 56 which is the rectified DC voltage of the AC source that supplies the triac, which changes in accordance with the dim value set at the triac. The other signal generated by rectifier 1 is VCC 84 which is the supply voltage for the controller circuitry and remains generally constant over dimming range, since this voltage is taken across the combination of the Zener diode and capacitor as shown. Note that the value of VCC is used as an input to the reference signal generator 48 which sets the reference value based on the value of VCC.

In addition to the foregoing components that provide preheat current, dimming functionality, and the generation of striking and steady state operational currents to the lamp, the controller 12 of the present invention may also include a reference voltage generator 48 that generates the reference voltage or voltages utilized by circuits which require a comparison to a reference voltage, as described in detail above.

Numerous modifications will be readily apparent to those skilled in the art, and all such modifications are deemed within the scope of the present invention. For example, the inverter topology described herein utilizing the A, B, C, D drives 54 and the H-Bridge MOSFETs 56 is a full bridge type inverter topology. The A, B, C and D drives operate to control the gates of the 4 H-Bridge MOSFETS, respectively, and may include cross-conduction protection circuitry to prevent a short circuit. The operation of such drive circuitry in the context of a full bridge/H-Bridge switching inverter is well known in the art, and is thus omitted. However, those skilled in the art will recognize that half-bridge, flyback, push pull, and other related topologies are equivalent to the functionality provided by a full-bridge inverter circuit, and are thus deemed equivalent in the controller 12 of the present invention. Likewise, the specific circuitry for those functional components of the controller 12 of FIG. 1 described herein may be replaced with other circuitry having the functional equivalent thereof.

Furthermore, although the present invention makes specific reference to a controller for HCFLs, the controller of the present invention is equally applicable to other lamp types that may require both heating and dimming capabilities. Such trivial changes are also deemed equivalent to the spirit and scope of the present invention, only as limited by the appended claims.

We claim:

1. An electronic ballast system, comprising:

a variable voltage source generating a first signal indicative of a desired dim value for a hot cathode fluorescent lamp, and a second signal indicative of the average power of said variable voltage source;

a ballast controller comprising:

lamp filament current control circuitry comprising preheat filament current control circuitry generating a preheat filament current to the filaments of said lamp for a predetermined time period and steady state filament current control circuitry generating a steady state filament heating current in reverse proportion to said desired dim value during times after said predetermined period of time;

dimming circuitry comprising a burst PWM (pulse width modulated) signal generator receiving said first signal and generating a PWM dimming signal proportional to a desired dim value;

current feedback circuitry receiving a signal indicative of the current supplied to said lamp and comparing said signal indicative of the current supplied to said lamp and said PWM dimming signal to generate a variable power control signal;

inverter circuitry receiving said variable power control signal and generating an AC signal proportional to said power control signal by inverting said second signal; and a resonant tank circuit coupled to said inverter circuitry receiving said AC signal to deliver striking and steady state sinusoidal power to said lamp.

2. An electronic ballast system as claimed in claim 1, wherein said preheat filament current control circuitry comprising a selector switch; said selector switch being controlled by an enable signal, said selector switch operable to cast through a predetermined filament preheat signal to generate a predetermined filament current for preheating the filaments of said lamp.

3. An electronic ballast system as claimed in claim 2, wherein said predetermined period of time being controlled by preheat timing control circuitry comprising a comparator that compares a voltage generated by a charging capacitor to a predetermined reference voltage, wherein said preheat filament current control circuitry operable for a time period for when the voltage on said charging capacitor is less than said reference voltage.

4. An electronic ballast system as claimed in claim 1, wherein said steady state filament current control circuitry operable to generate said steady state filament heating current between a predetermined minimum value and predetermined maximum value.

5. An electronic ballast system as claimed in claim 1, wherein said inverter circuitry comprising a full bridge inverter circuit.

6. An electronic ballast, comprising:

a variable voltage source generating a first signal indicative of a desired dim value for a hot cathode fluorescent lamp, and a second signal indicative of the average power of said variable voltage source;

a ballast controller comprising:

open loop lamp filament current control circuitry comprising preheat filament current control circuitry generating a preheat filament current to the filaments of said lamp for a predetermined time period and a steady state filament heating current during times after said predetermined period of time;

dimming circuitry to vary the power delivered to said lamp as a function of the value of said first signal; and a full bridge inverter circuit generating an AC signal from said second signal based on said dimming circuitry; and a resonant tank circuit coupled to the output of said full bridge inverter receiving said AC signal and generating a sinusoidal signal to deliver striking and steady state power to said lamp.

7. An electronic ballast system as claimed in claim 6, wherein said preheat filament current control circuitry comprising a selector switch; said selector switch being controlled by an enable signal, said selector switch operable to cast through a predetermined filament preheat signal to generate a predetermined filament current for preheating the filaments of said lamp.

8. An electronic ballast system as claimed in claim 7, wherein said predetermined period of time being controlled by preheat timing control circuitry comprising a comparator that compares a voltage generated by a charging capacitor to a predetermined reference voltage, wherein said preheat filament current control circuitry operable for a time period for when the voltage on said charging capacitor is less than said reference voltage.

9. An electronic ballast system as claimed in claim 6, wherein said steady state filament current control circuitry operable to generate said steady state filament heating current between a predetermined minimum value and predetermined maximum value.

10. An electronic ballast system, wherein said lamp filament current control circuitry further comprising a high frequency pulse with modulation circuit comprising a comparator that compares an output signal generated by said preheat filament current control circuitry or said steady state filament current control circuitry to a high frequency saw tooth to signal and generating a signal having a duty cycle based on said output signal and said high frequency saw tooth to signal.

11. An electronic ballast system, wherein said lamp filament current control circuitry further comprising a high frequency pulse with modulation circuit comprising a comparator that compares an output signal generated by said preheat filament current control circuitry or said steady state filament current control circuitry to a high frequency saw tooth to signal and generating a signal having a duty cycle based on said output signal and said frequency saw tooth to signal.

* * * * *

UNITED STATES PATENT AND TRADEMARK OFFICE

CERTIFICATE OF CORRECTION

PATENT NO. : 6,531,831 B2
DATED : March 11, 2003
INVENTOR(S) : John Chou and Yung-Lin Lin It is certified that error appears in the above-identified patent and that said Letters Patent is hereby corrected as shown below:

Title page,
Item [73], Assignee, please delete "Grand Caymen" and insert -- Grand Cayman --.

Signed and Sealed this

Fifteenth Day of July, 2003

JAMES E. ROGAN
*Director of the United States Patent and Trademark Office*